US008733309B2

(12) United States Patent
Weber

(10) Patent No.: US 8,733,309 B2
(45) Date of Patent: May 27, 2014

(54) CAMSHAFT ADJUSTER

(71) Applicant: Jürgen Weber, Herzogenaurach (DE)

(72) Inventor: Jürgen Weber, Herzogenaurach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/668,622

(22) Filed: Nov. 5, 2012

(65) Prior Publication Data

US 2013/0112162 A1 May 9, 2013

(30) Foreign Application Priority Data

Nov. 3, 2011 (DE) ..... 10 2011 085 693

(51) Int. Cl.
*F01L 1/34* (2006.01)

(52) U.S. Cl.
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS

2010/0101516 A1* 4/2010 Hertrich ..... 123/90.17

* cited by examiner

*Primary Examiner* — Zelalem Eshete
(74) *Attorney, Agent, or Firm* — Volpe and Koenig, P.C.

(57) ABSTRACT

A camshaft adjuster (1) is disclosed that has material openings (5) in the vanes (4) of the drive element (2), with these openings being divided into two sub-spaces (12, 13), wherein one sub-space (12) is provided for the penetration of a connecting element (6) and the other sub-space (13) does not allow the penetration of a connecting element (6).

9 Claims, 3 Drawing Sheets

CAMSHAFT ADJUSTER

CROSS-REFERENCE TO RELATED APPLICATIONS

This application claims the benefit of German Patent Application No. 102011085693.5, filed Nov. 3, 2011, which is incorporated herein by reference as if fully set forth.

FIELD OF THE INVENTION

The invention relates to a camshaft adjuster.

BACKGROUND

Camshaft adjusters are used in internal combustion engines for varying the control times of combustion chamber valves, in order to variably shape the phase relation between the crankshaft and the camshaft in a defined angular range between a maximum advanced position and a maximum retarded position. The adaptation of the control times to the current load and rotational speed reduces fuel consumption and the emissions. For this purpose, camshaft adjusters are integrated in a drive train by which a torque is transmitted from the crankshaft to the camshaft. This drive train can be constructed, for example, as a belt, chain, or gearwheel drive.

In a hydraulic camshaft adjuster, the driven element and the drive element form one or more pairs of compression chambers that act opposite to each other and can be charged with hydraulic medium. The drive element and the driven element are arranged coaxially. The filling and emptying of individual compression chambers generates a relative movement between the drive element and the driven element. A spring with rotational effect between the drive element and the driven element forces the drive element in a preferred direction relative to the driven element. This preferred direction can be in the same direction or opposite the direction of rotation.

One construction of the hydraulic camshaft adjuster is the vane cell adjuster. The vane cell adjuster has a stator, a rotor, and a drive wheel with external teeth. The rotor is constructed as a driven element that can be locked in rotation usually with the camshaft. The drive element includes the stator and the drive wheel. The stator and the drive wheel are locked in rotation with each other or are alternatively constructed as one piece. The rotor is arranged coaxial to the stator and within the stator. With their radially extending vanes, the rotor and the stator form oppositely acting oil chambers that can be charged by oil pressure and allow a relative rotation between the stator and the rotor. The vanes are constructed either integrally with the rotor or the stator or arranged as "connected vanes" in grooves of the rotor or of the stator provided for these vanes. The vane cell adjusters also have various sealing covers. The stator and the sealing covers are secured with each other by several screw connections.

A different construction of the hydraulic camshaft adjuster is the axial piston adjuster. Here, a displacement element is displaced using oil pressure in the axial direction, which generates, via helical gearing, a relative rotation between a drive element and a driven element.

Another construction of a camshaft adjuster is the electromechanical camshaft adjuster that has a triple-shaft gear (for example, a planetary gear). Here, one of the shafts forms the drive element and a second shaft forms the driven element. By using the third shaft, rotational energy can be fed to the system by a control device, for example, an electric motor or a brake, or energy can be discharged from the system. There can also be a spring that boosts or lessens the relative rotation between the drive element and the driven element.

SUMMARY

The object of the invention is to provide a camshaft adjuster that has a Poka-Yoke arrangement.

This is met by a device according to the invention.

The material opening of the drive element is divided into two sub-spaces. A first sub-space is provided for the installation with the connecting element, while an opening cross section of the second sub-space is constructed so that the connecting element cannot pass through this second sub-space or cannot penetrate into the second sub-space.

The two sub-spaces could be connected into one in a material-free way or could be separated from each other by material, e.g., a wall.

The first and the second sub-space each have at least a first opening cross section. The first opening cross section of the first sub-space is provided for the insertion of the connecting element, while the first opening cross section of the second sub-space is incompatible to the cross section of the connecting element. In this way, at least the first sub-space can be constructed as a blind hole, optionally with an additional thread.

Through the invention it is achieved that the connecting element can penetrate only into the first sub-space and thus also projects inward after successful installation. The first opening cross section of the second sub-space has a geometry that is incompatible to the connecting element, so that the connecting element does not fit through the first opening cross section of the second sub-space and thus incorrect installation of the connecting element with the second sub-space is ruled out. In this way it is guaranteed that the first sub-space provided for the connection is used only for this purpose, wherein, in contrast to the second sub-space, the purpose of mass reduction of the drive element is fulfilled. For the mass reduction, the second sub-space has a component-free construction. Thus, no component of the camshaft adjuster projects into the second sub-space.

The material opening could be constructed as a passage opening. A passage opening has another opening cross section in addition to the first opening cross section. Ideally, the passage opening extends like the material opening predominantly in the axial direction, i.e., in the direction of the axis of rotation of the camshaft adjuster. The first and/or second sub-space each has at least two opening cross section. The connecting element can project through the first and/or the additional opening cross section of the first sub-space, but not through at least one opening cross section of the second sub-space.

In one construction of the invention, the material opening is constructed with its first and second sub-space by the vane of the drive element. The material opening is advantageously constructed as a passage opening. Areas of larger material concentrations of the vane are offset by the second sub-space. Thus, the vane has walls with predominantly equal wall thicknesses.

Advantageously, material is saved, e.g., through sintering. The material concentrations that are harmful for a casting process can be further avoided through the introduction of at least one of the second sub-spaces, which avoids the formation of voids during cooling and thus leads to a more reliable component.

In addition, in a hardening process, e.g., during case hardening, the atmosphere of the furnace can better reach or flow around the material. Thus, a higher efficiency in the manufacturing process is achieved and costs are reduced.

In one advantageous construction, the material opening has several second sub-spaces. The plurality of second sub-spaces is allocated to a first sub-space. The first sub-space with the second sub-spaces can be connected into one, as already mentioned, in a material-free manner or separated from each other by material, e.g., by a wall. Ideally, the second sub-spaces flank the first sub-space. Especially preferred is a symmetric or patterned arrangement of the second sub-spaces relative to the first sub-space.

In one construction of the invention, the shortest distance between two opposite boundary surfaces in the cross section of the second sub-space is less than the shortest distance between two opposite boundary surfaces in the cross section of the first sub-space. If the shortest distance of the opposite boundary surfaces of the second sub-space is less than the shortest distance between two opposite boundary surfaces of the first sub-space in the cross section, then it is not possible for the connecting element to be joined with the second sub-space and consequently it must be joined with the first sub-space.

For boundary surfaces arranged parallel to each other, a shortest distance in each cross-sectional plane can be determined perpendicular to one of the boundary surfaces. The boundary surfaces must be provided physically and must not be intersected physically to be able to determine a shortest distance.

If the physically provided boundary surfaces for determining the shortest distance are not arranged parallel to each other, then the cross-sectional plane is the surface in which the distance assumes the global minimum. The boundary surfaces could be arranged, e.g., tapering toward each other with wedge-shaped constructions.

In one especially preferred construction, the drive element is constructed integrally with teeth. The teeth are constructed on an outer peripheral surface of the drive element.

In one construction of the invention, a component adjacent to the drive element has a separate material opening that opens toward the material opening of the drive element. The opening of the material opening of the adjacent component and the drive element are partially opposite each other or an opening completely encloses the other.

In one preferred construction, the drive element is constructed integrally with the adjacent component. The drive element here has a pot-shaped construction, wherein the material opening must be constructed advantageously only on one component. In addition, the drive element could have integrally formed teeth for a control drive.

In one advantageous construction, the first sub-space has a thread and the second sub-space does not. The connecting element likewise has a thread that matches the thread of the first sub-space. The thread of the first sub-space is advantageously not completely circular, but constructed on two opposite boundary surfaces. The area between the boundary surfaces has a material-free connection to the second sub-space.

In one preferred construction of the invention, the drive element is constructed from a sintered material. A sintering process can advantageously form the material opening in one processing step. Then the first sub-space can be provided with a thread and post-processing can be performed for a type of fitting between the first sub-space and the connecting element and/or another component, such as a socket or sleeve, for holding the connecting element.

The construction of the sub-spaces according to the invention produces a Poka-Yoke effect that rules out an installation of the connecting element with a sub-space that is not provided for this purpose. During installation there is only one solution for joining the connecting element to the corresponding first sub-space. Furthermore, the second sub-space produces a reduction in weight. The geometry of the second sub-space can be freely selected for lightweight construction so that only the first opening cross section of the second sub-space must be constructed suitably for the penetration with the connecting element.

BRIEF DESCRIPTION OF THE DRAWINGS

Embodiments of the invention are shown in the figures. Shown are.

DETAILED DESCRIPTION OF THE PREFERRED EMBODIMENTS

Figure 1:
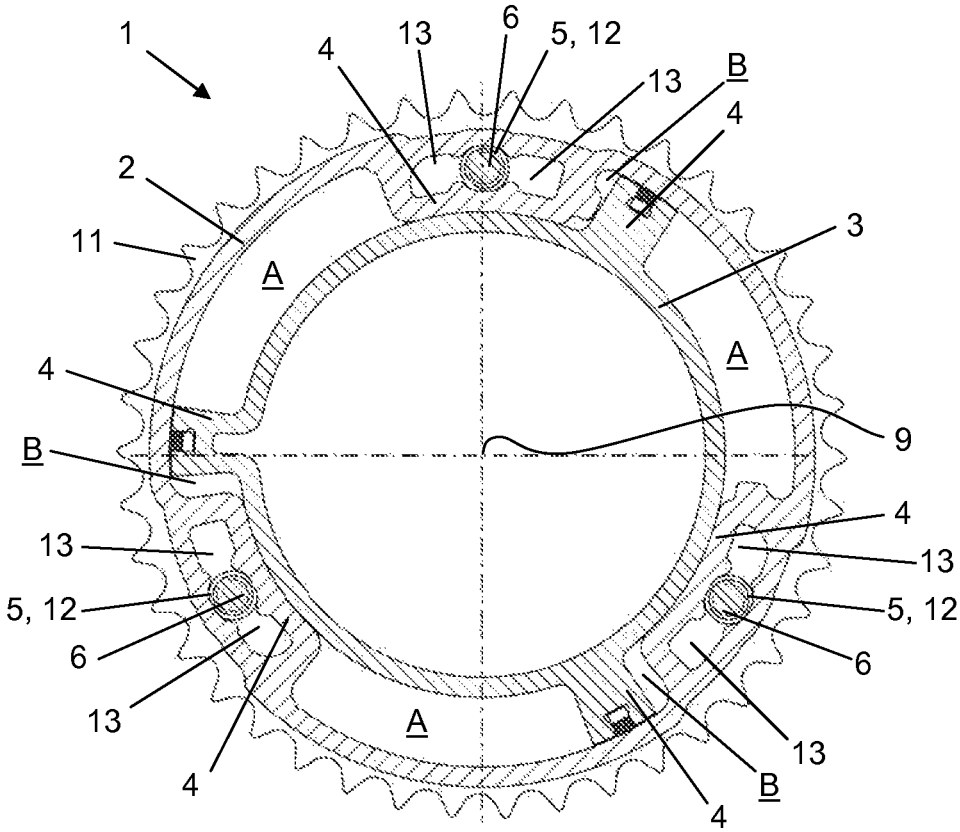
FIG. 1 is a view of a camshaft adjuster in cross section.

FIG. 1 shows a camshaft adjuster 1 in cross section. The cross-sectional plane is perpendicular to the axis of rotation 9 of the camshaft adjuster 1. A drive element 2 and a driven element 3 are arranged concentric to the axis of rotation 9. Both have radially oriented vanes 4 that partition work chambers A and B that work opposite each other. The effect and operation of a hydraulic camshaft adjuster 1 is known from the prior art.

The drive element 2 has teeth 11 that are constructed integrally with this drive element on its outer peripheral surface. The vanes 4 of the drive element 2 further have the material opening 5 according to the invention that is divided into a first sub-space 12 and into two second sub-spaces 13. The first sub-space 12 is located essentially in the middle in the vanes 4, wherein the two second sub-spaces 13 flank the first sub-space 12 laterally or in the peripheral direction. The first sub-space 12 is penetrated by a connecting element 6. The connecting element 6 is here constructed as a screw or threaded bolt and fixes components of the camshaft adjuster 1 arranged along the axis of rotation 9 to each other. Alternatively, the connecting element 6 could also be constructed as a pin or tab.

The vanes 4 of the drive element 2 and also the vanes 4 of the driven element 3 are present in sets of three. Each vane 4 of the driven element 3 has a spring-mounted sealing element known from the prior art on its radial, end-face surface.

Figure 2:
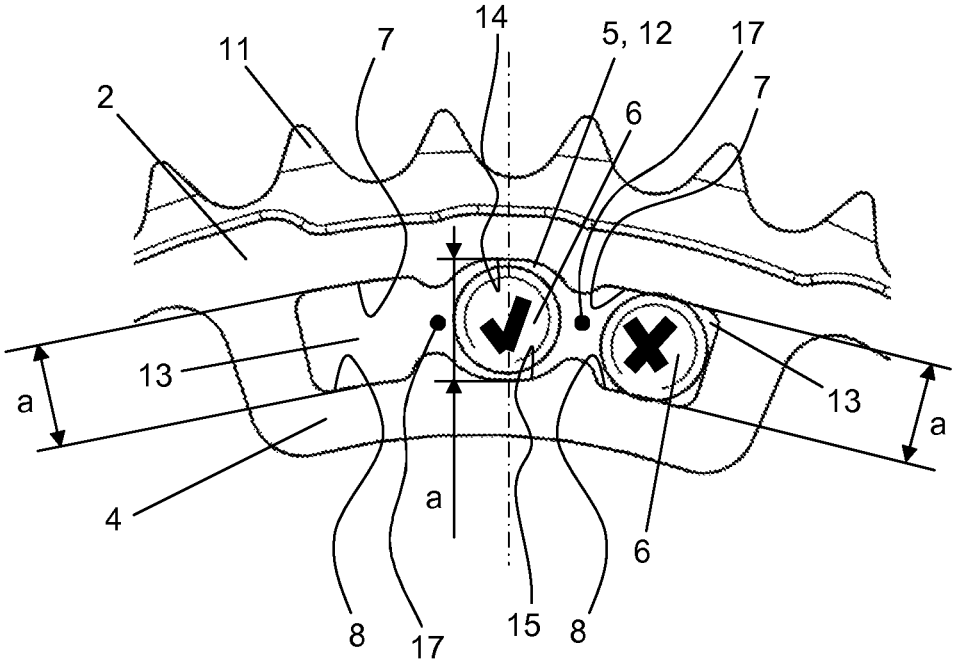
FIG. 2 is a detailed view of a vane of a drive element with an embodiment of the sub-chambers according to the invention.

FIG. 2 shows a detailed view of a vane 4 of a drive element 2 with an embodiment of the sub-spaces 12 and 13 according to the invention. The arrangement is similar to that shown in FIG. 1 but with FIG. 2, the feature that is essential to the invention of the difference of sub-space 12 to sub-space 13 should be made clear. The connecting element 6 is shown in two imaginary positions. One position in which the connecting element 6 is arranged within the first sub-space 12 is marked with a check and signals that sufficient clearance is given for installation of the connecting element 6 with the first sub-space 12. The other position in which the connecting element 6 is arranged within the second sub-space 13 is marked with an X and signals that the connecting element 6 has an overlap of materials with the boundary surfaces 7 and/or 8, i.e., there is not sufficient clearance for the installation of the connecting element 6 with the second sub-space 12. The boundary surfaces 7 and 8 of the second sub-space 12 lie opposite each other. The entire material opening 5 consisting of the first sub-space 12 and the two sub-spaces 13 is oriented parallel to the axis of rotation 9. The boundary surfaces 7 and 8 are thus likewise parallel to each other. The shortest distance a between the two boundary surfaces 7 and 8 is less than the diameter of the connecting element 6 and thus also less than the shortest distance a of the two opposite boundary surfaces 14 and 15 of the first sub-space 12. This produces the Poka-Yoke effect. In this embodiment, the diameter of the connecting element 6 is less than the shortest distance a of the boundary surfaces 14 and 15. The material-free connection points 17 of the first sub-space 12 with the two second sub-spaces 13 are constructed tapering in the peripheral direction of the camshaft adjuster 1 by the walls of the vane 4 of the drive element 2.

The material opening 5 with its sub-spaces 12 and 13 is here constructed as a passage opening, i.e., the material opening 5 extends along the axis of rotation 9 completely through the drive element 2. The second sub-spaces 13 have a box-like construction in cross section, wherein the first sub-space 12 has an approximately circular or oval shape in cross section.

Figure 3:
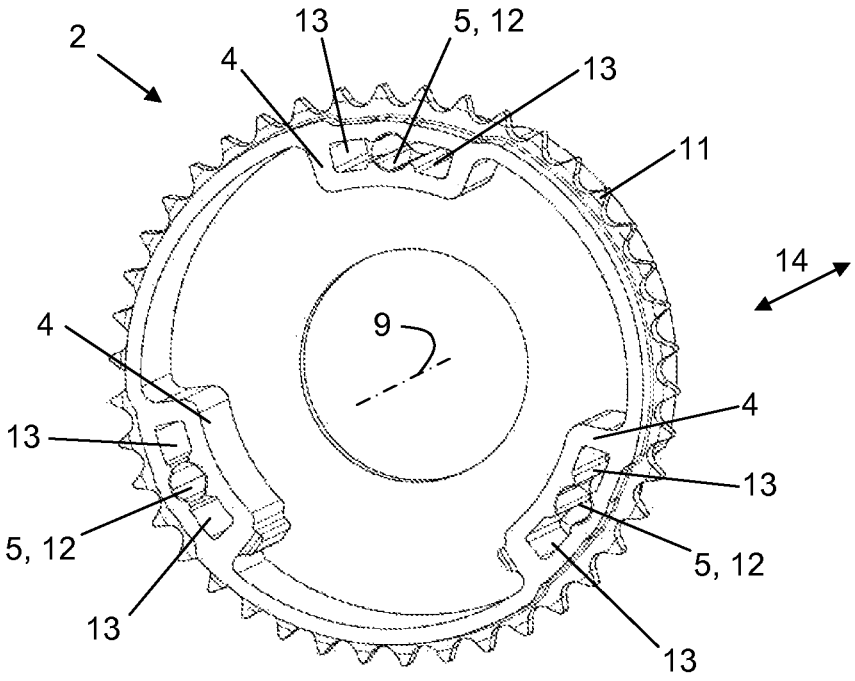
FIG. 3 is a perspective view of a drive element in one embodiment.

FIG. 3 shows a perspective view of a drive element 2 in one embodiment. The drive element 2 is constructed integrally both with the teeth 11 and also with an adjacent component 10. The material opening 5 is similar in its cross-sectional shape to that from FIG. 1 and/or FIG. 2. The material opening 5 and its sub-spaces 12 and 13 coincide on the entire axial length of the drive element 2 with the drive element 2 along the axis of rotation 9. The pot-shaped drive element 2 has a concentric central opening that can be penetrated by a driven element 3 or a component arranged locked in rotation with a camshaft and not shown in more detail.

LIST OF REFERENCE NUMBERS

1) Camshaft adjuster
2) Drive element
3) Driven element
4) Vane
5) Material opening
6) Connecting element
7) Boundary surface
8) Boundary surface
9) Axis of rotation
10) Adjacent component
11) Teeth
12) First sub-space
13) Second sub-space
14) Axial direction
15) Boundary surface
16) Boundary surface
17) Material-free connecting point
a) Distance
A) Work chamber
B) Work chamber

The invention claimed is:

1. Camshaft adjuster comprising:
a drive element and a driven element,
the drive element and the driven element each have a plurality of vanes,
the vanes of the drive element and the driven element partition work chambers that act opposite each other,
the work chambers are chargeable with hydraulic medium, in order to achieve a relative rotation between the drive element and the driven element about an axis of rotation of the camshaft adjuster,
the drive element has a material opening for the fixed connection to an adjacent component in an axial direction,
a first sub-space of the material opening is penetrated by a connecting element, and
the material opening has a second sub-space that has a geometry that is, in contrast to the first sub-space, incompatible with the connecting element and is component free.

2. Camshaft adjuster according to claim 1, wherein the material opening is constructed with the first and second sub-spaces in the vane of the drive element.

3. Camshaft adjuster according to claim 1, wherein the material opening has a plurality of the second sub-spaces.

4. Camshaft adjuster according to claim 1, wherein a shortest distance (a) between two opposite boundary surfaces in a cross section of the second sub-space is less than a shortest distance (a) between two opposite boundary surfaces in a cross section of the first sub-space.

5. Camshaft adjuster according to claim 1, wherein the drive element is constructed integrally with teeth.

6. Camshaft adjuster according to claim 1, wherein a component that is adjacent to the drive element has a separate material opening that opens toward the material opening of the drive element.

7. Camshaft adjuster according to claim 6, wherein the drive element is constructed integrally with the adjacent component.

8. Camshaft adjuster according to claim 1, wherein the first sub-space has a thread and the second sub-space does not include a thread.

9. Camshaft adjuster according to claim 1, wherein the drive element is constructed from a sintered material.

* * * * *